US008413283B1

(12) United States Patent
Estep

(10) Patent No.: US 8,413,283 B1
(45) Date of Patent: Apr. 9, 2013

(54) HANDS-FREE POT SCRUBBER

(76) Inventor: Brent McNair Estep, San Diego, CA (US)

( * ) Notice: Subject to any disclaimer, the term of this patent is extended or adjusted under 35 U.S.C. 154(b) by 514 days.

(21) Appl. No.: 12/714,564

(22) Filed: Mar. 1, 2010

Related U.S. Application Data

(60) Provisional application No. 61/156,489, filed on Feb. 28, 2009.

(51) Int. Cl.
*A46B 13/02* (2006.01)

(52) U.S. Cl.
USPC ..... 15/29; 15/56; 15/74; 15/28

(58) Field of Classification Search ..... 15/56, 59, 15/74, 28, 29, 21.1, 22.2
See application file for complete search history.

(56) References Cited

U.S. PATENT DOCUMENTS

| | | | | |
|---|---|---|---|---|
| 3,715,770 | A | 2/1973 | Obregon-Gomez | |
| 3,864,779 | A | 2/1975 | Thomas | |
| 3,947,909 | A | 4/1976 | Kuo | |
| 4,060,871 | A | 12/1977 | Bryerton | |
| 4,062,082 | A | 12/1977 | Azzopardi | |
| 4,223,418 | A | 9/1980 | Pedrini | |
| 5,279,672 | A * | 1/1994 | Betker et al. | 134/18 |
| 5,450,646 | A | 9/1995 | McHugh et al. | |
| 5,720,395 | A * | 2/1998 | Schock et al. | 209/700 |
| 5,956,792 | A | 9/1999 | Gutelius et al. | |
| 7,363,673 | B2 * | 4/2008 | Schonewille et al. | 15/29 |
| 7,507,296 | B2 * | 3/2009 | Sugarman et al. | 134/6 |
| 7,765,638 | B2 * | 8/2010 | Pineschi et al. | 15/377 |
| 7,837,958 | B2 * | 11/2010 | Crapser et al. | 422/291 |
| 2004/0123410 | A1 | 7/2004 | Terry et al. | |

FOREIGN PATENT DOCUMENTS

GB 2141620 A 1/1985

* cited by examiner

*Primary Examiner* — Shay Karls
(74) *Attorney, Agent, or Firm* — Andover Patents, LLC; Daniel N. Beinart

(57) ABSTRACT

A portable, hands-free device for cleaning a cooking utensil includes a motor, a battery electrically coupled to the motor, and scrub brushes mechanically coupled to the motor.

27 Claims, 16 Drawing Sheets

HANDS-FREE POT SCRUBBER

CROSS-REFERENCE TO RELATED APPLICATIONS

This application claims priority to U.S. Provisional Application No. 61/156,489 filed Feb. 28, 2009, the entire contents of which are hereby incorporated by reference, as if fully set forth herein.

FIELD OF THE INVENTION

The present invention relates generally to the field of motorized cleaning devices, and more particularly to a hands-free device that is used to clean pots, pans and other cookware, from here on to be described as cooking utensils.

BACKGROUND OF THE INVENTION

Existing devices for cleaning cooking utensils have various deficiencies. For example, some must be fixed in place (e.g., a dishwasher), and therefore, a cooking utensil must be brought to the device for cleaning, rather than vice-versa. In addition, a dishwasher is not capable of adequately cleaning certain cooking utensils, e.g., pots with burned food or grease residue. Other existing devices for cleaning cooking utensils are not fixed in place (e.g., a Black & Decker Powered Scrubber), but these devices have the drawback of requiring a user to hold and guide the device in its operation, rather than permitting a user to use the device in a hands-free fashion.

Therefore a need exists for a device that permits the cleaning of cooking utensils without the user holding on to the device or the cooking utensil. Furthermore, a need exists for a device for cleaning cooking utensils that permits an operator to attend to other activities during its operation.

A device constructed according to the principles of the present invention addresses these deficiencies.

BRIEF SUMMARY OF THE INVENTION

In accordance with principles of the present invention, one embodiment of a hands-free pot scrubber for cleaning cooking utensils includes a motor, a battery electrically coupled to the motor, and scrub brushes mechanically coupled to the motor.

Figure 1:
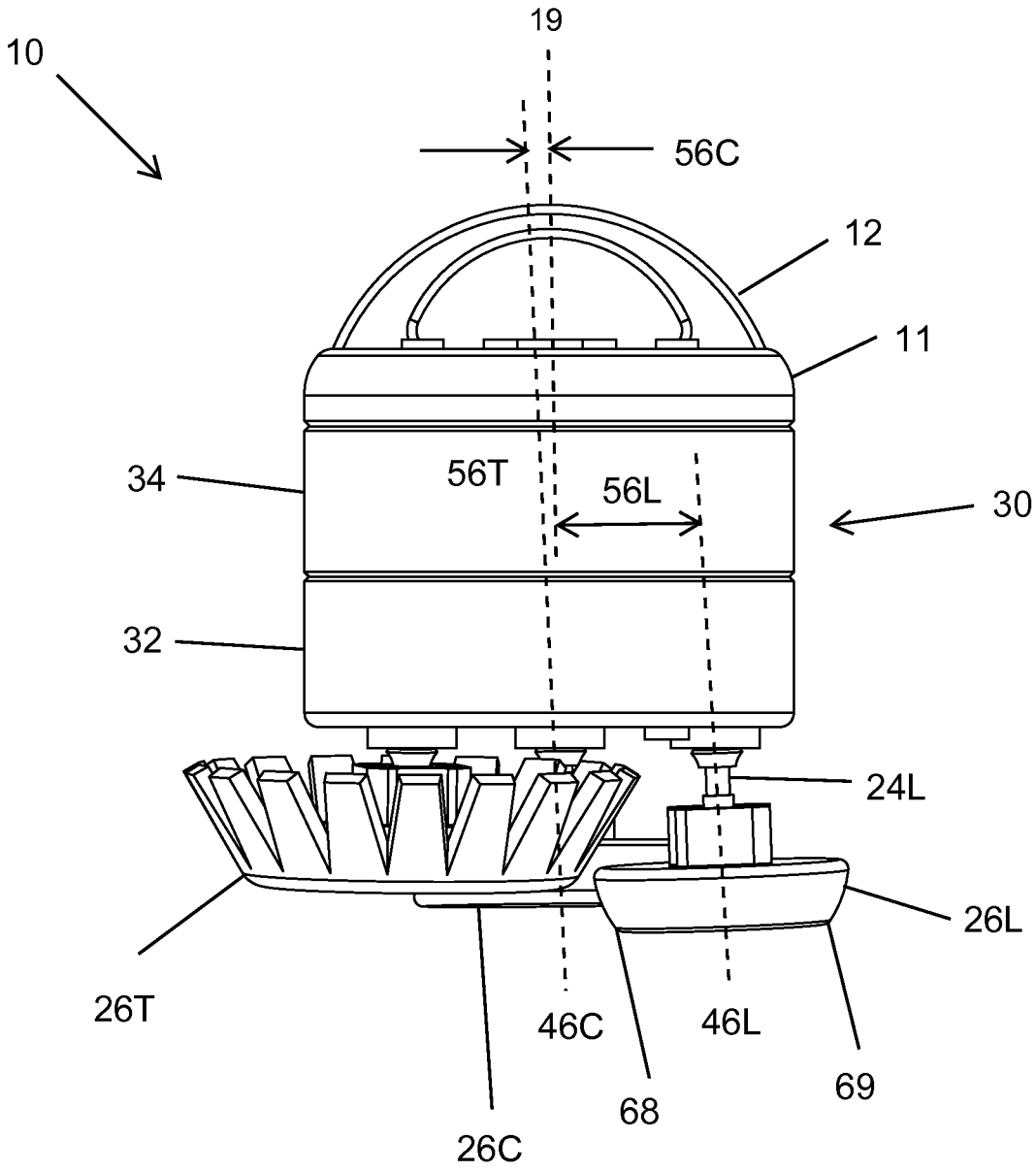
FIGS. 1-3 depict a front, side, and perspective view, respectively, of a first embodiment of a hands-free pot scrubber in accordance with principles of the present invention.

Other objects and features of the present invention will become apparent from the detailed description considered in connection with the accompanied drawings. It is to be understood however, that the drawings are designed as an illustration only and not as definition of the limits of the invention. It is obvious that many changes and modifications may be made thereunto without departing from the spirit and scope of the invention.

DETAILED DESCRIPTION OF THE INVENTION

FIGS. 1-8 depict a first embodiment of a portable hands-free pot scrubber in accordance with principles of the present invention. The hands-free pot scrubber 10 comprises a cover 11 having a handle 12, base section 32, top section 34, drive gear 17, rod gears 16, drive chain 18, motor 20, motor shaft 21, batteries 22, switch 23, drive members or rods 24 (also referred to as shafts), scrub brush mounts 25, scrub brushes 26, and electrical conductors (not shown), e.g., wires, electrically connecting the batteries 22, the switch 23 and the motor 20.

Figure 4:
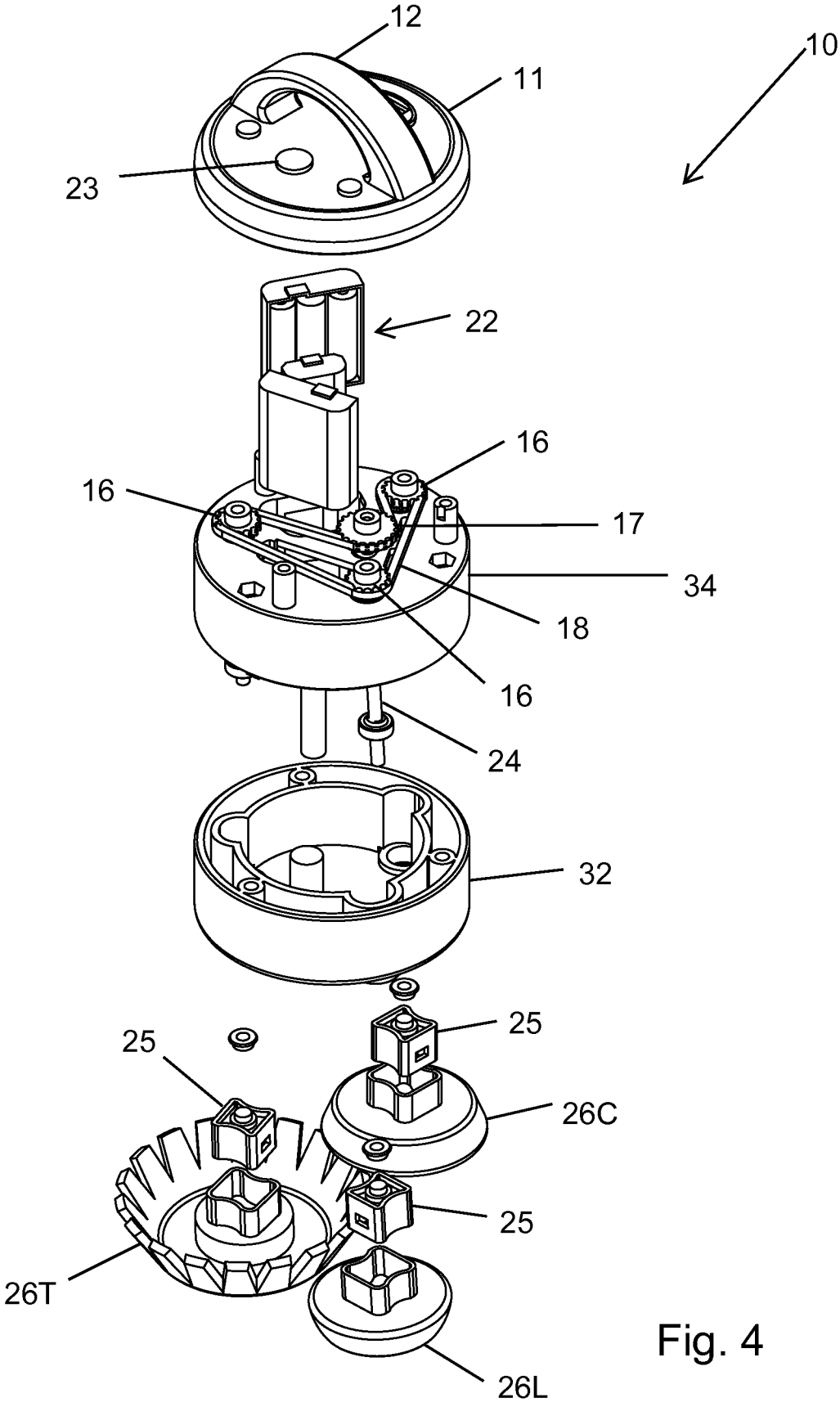
FIG. 4 is an exploded view of the hands-free pot scrubber depicted in FIG. 1.

The cover 11, top section 34 and base section 32 are assembled to fit together as depicted in FIG. 4, thus forming a substantially waterproof housing 30 and substantially rigid frame for the support of other components of the hands-free pot scrubber 10. When assembled, the drive rods 24 extend through matching openings in the base section 32, and the scrub brush mounts 25 are attached to the drive rods 24. The scrub brushes 26 are attached to the scrub brush mounts 25. While the scrub brushes 26 depicted in FIGS. 1-8 are each substantially circular with non-equal diameters, one skilled in the art will recognize that two or more of the scrub brushes 26 may have substantially equal diameters. Furthermore, a scrub brush 26 may alternatively be of non-circular shape, e.g., rectangular.

Figure 2:
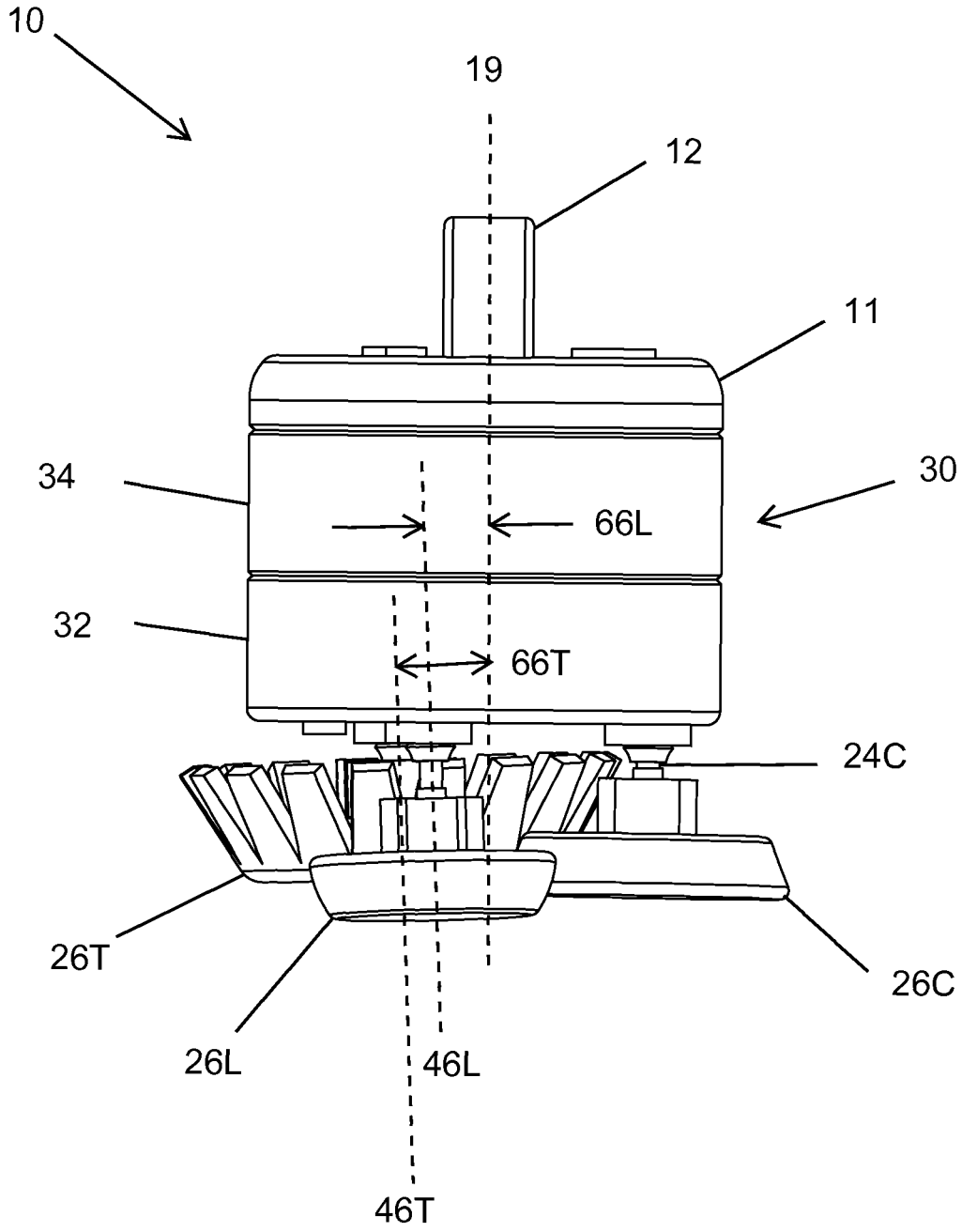
Figure 3:
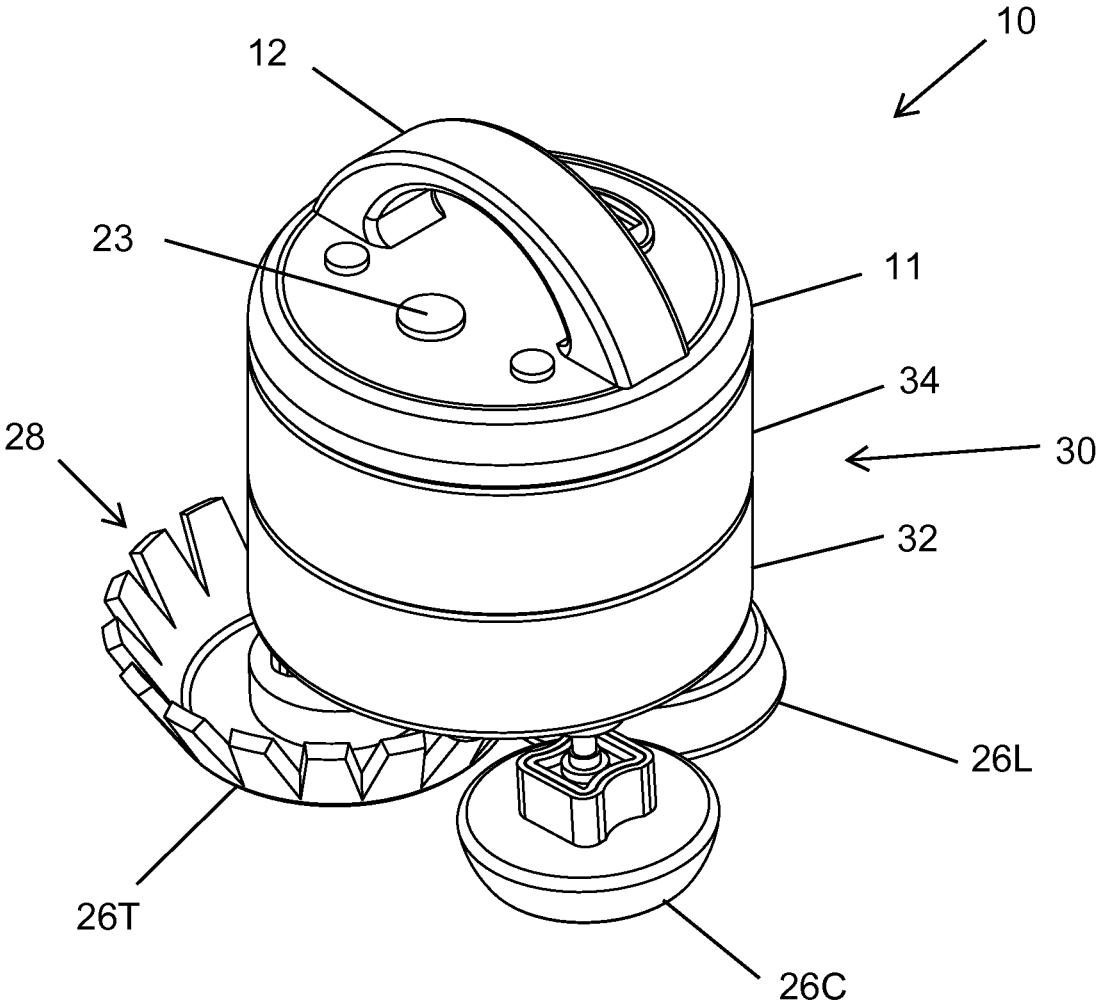
Figure 5:
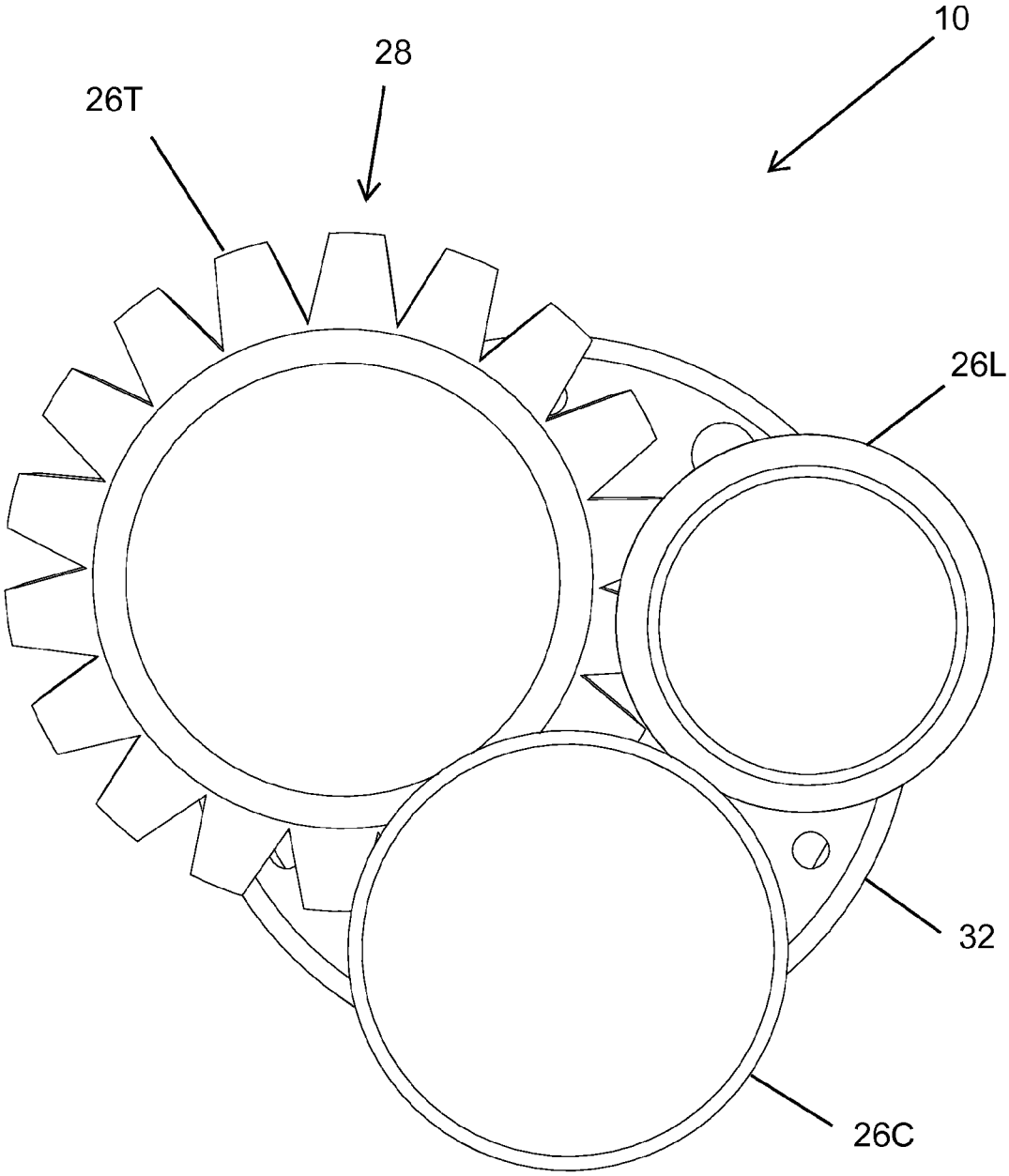
FIG. 5 is a view of the bottom of the hands-free pot scrubber depicted in FIG. 1.
Figure 6:
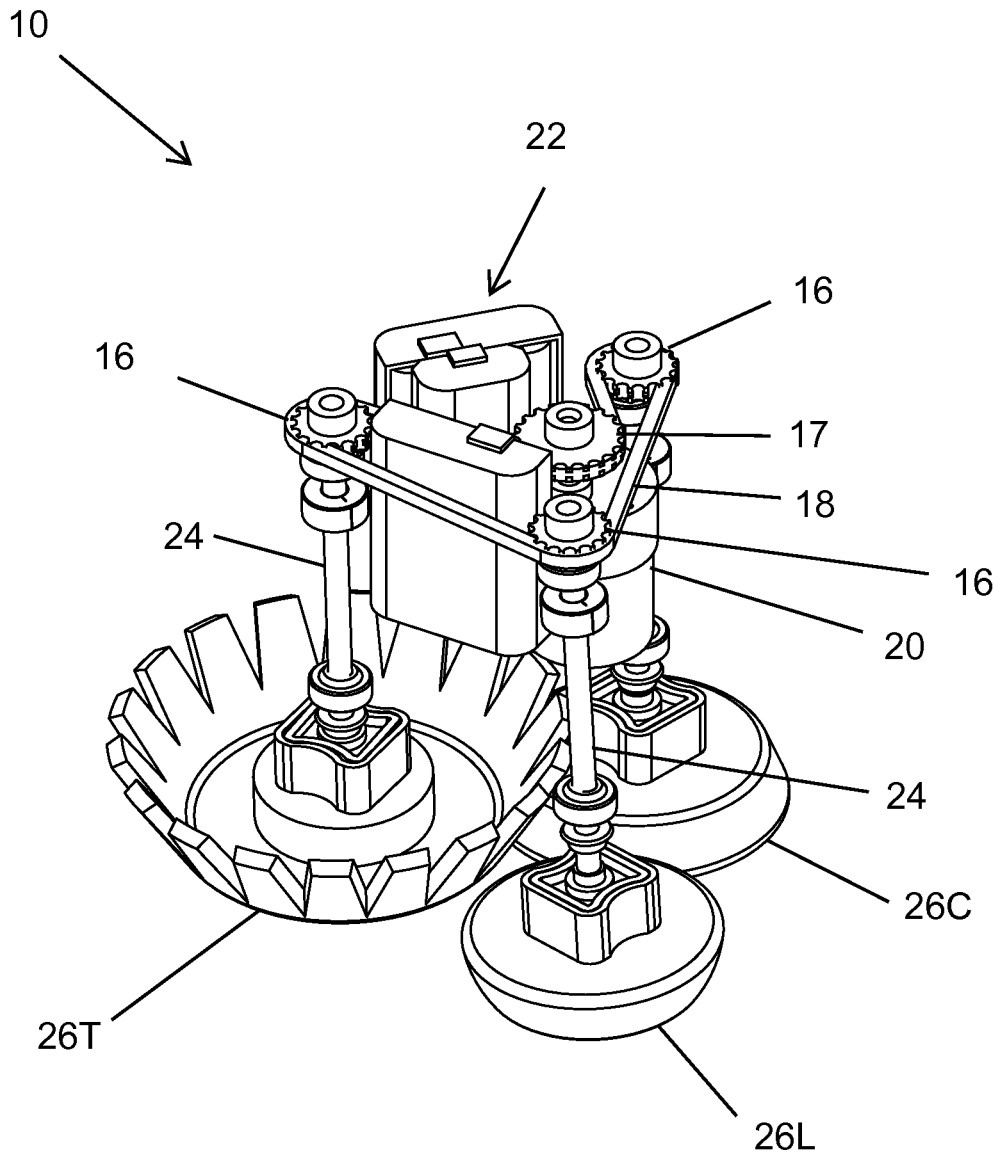
FIG. 6 is a view of components of the hands-free pot scrubber depicted in FIG. 1 without a housing.
Figure 7:
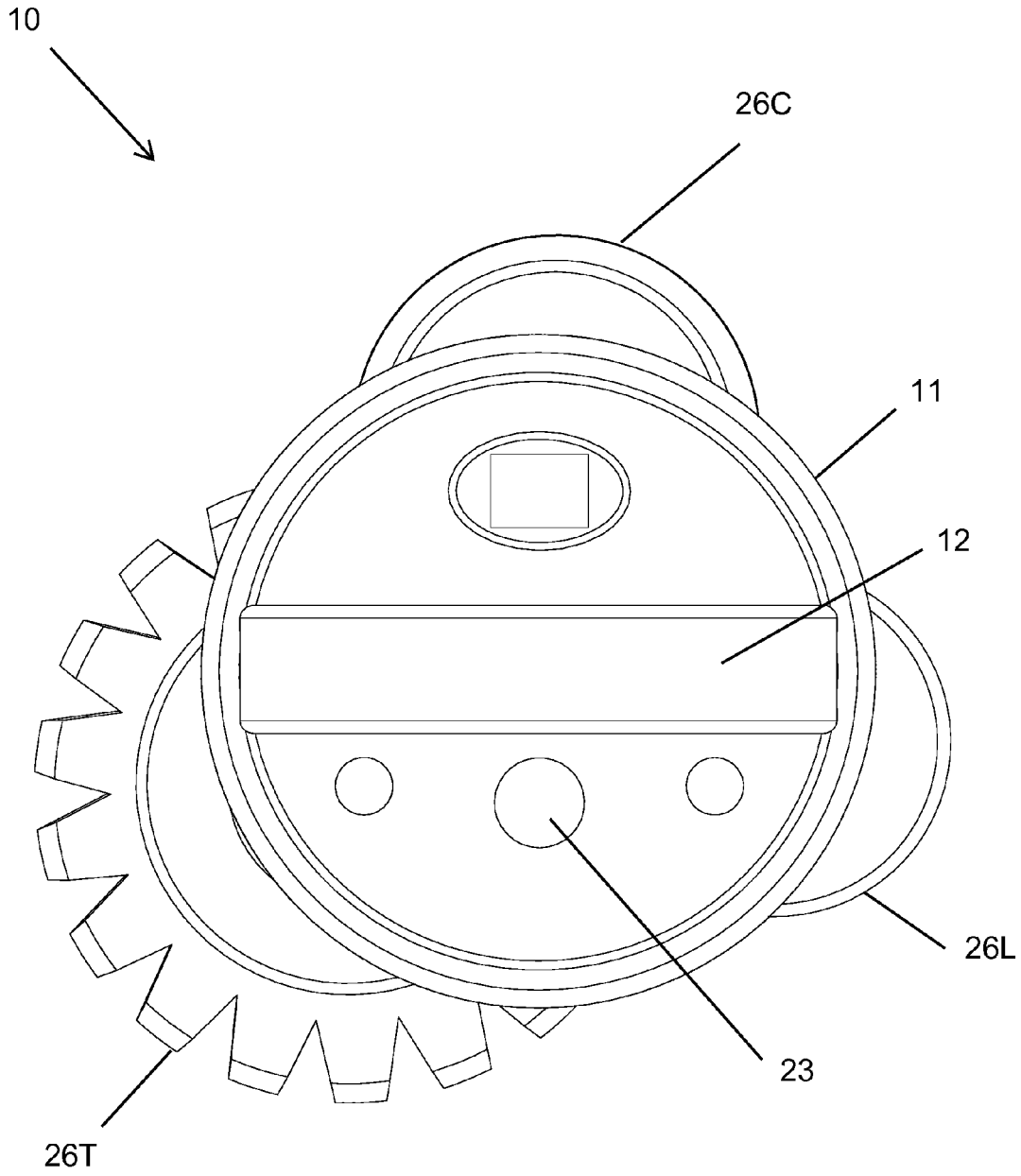
FIG. 7 is a top view of the hands-free pot scrubber depicted in FIG. 1.
Figure 8:
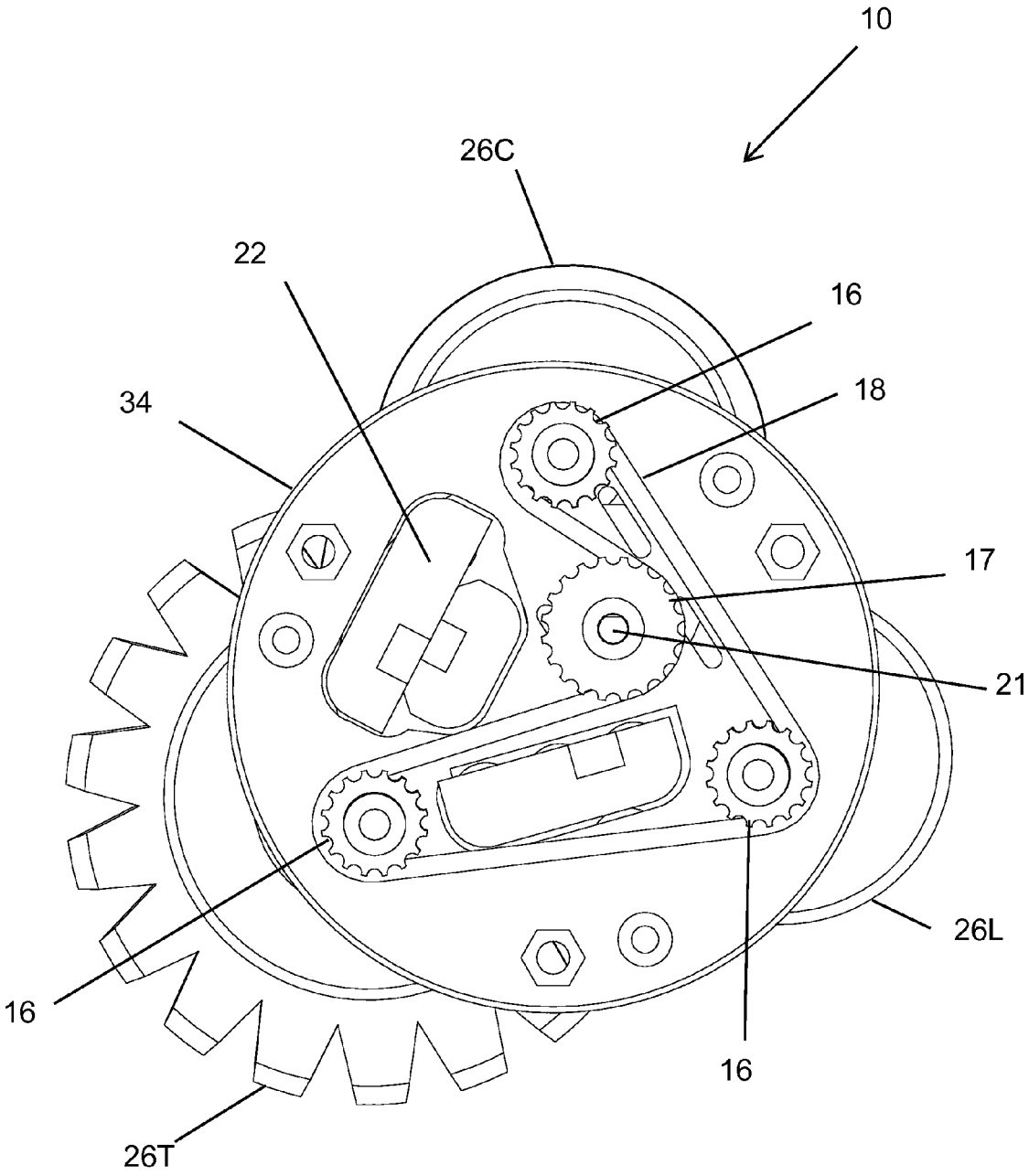
FIG. 8 is a top view without a cover of the hands-free pot scrubber depicted in FIG. 1.

As depicted in FIGS. 1-2, a central axis 19 of a hands-free pot scrubber 10 is disposed substantially in the center of the pot scrubber 10, aligned substantially vertically when the hands-free pot scrubber 10 is placed in an operational position on top of a substantially horizontal cooking utensil surface or food preparation surface. Furthermore, as depicted in FIG. 5, the scrub brushes 26 are arranged asymmetrically around the central axis 19.

The junctions of the cover 11, top section 34 and base section 32 may be sealed to prevent water penetration, e.g., with one or more O-rings. In addition, the drive rods 24 may be sealed, e.g., with sealed spherical bearings, stainless steel or composite spherical bearings and separate rubber shaft seals.

One skilled in the art will recognize that the batteries 22 may be a single battery, a plurality of batteries or a battery pack comprised of a plurality of batteries. Furthermore, the batteries 22 may be single-use or rechargeable.

A hands-free pot scrubber 10 may also include additional components (not shown): a soap dispenser (either manual or automatic) for release of soap (or other cleaning liquid) during operation.

In operation, a hands-free pot scrubber 10 is placed on top of a substantially horizontal surface of a cooking utensil to be cleaned. Water and soap are typically placed within the cooking utensil. When a user is ready to operate the hands-free pot scrubber 10, he or she operates the switch 23. The batteries 22, which are electrically coupled to the switch 23 and motor 20 by electrical conductors as described above, power the motor 20 after the user operates the switch 23. The drive gear 17 is attached to the motor shaft 21 and is fitted with the drive chain 18, which in turn threads around each of the rod gears 16. Each rod gear 16 and scrub brush 26 is attached to the top and bottom end, respectively, of a drive rod 24. Thus, the motor 20 is mechanically coupled to the motor shaft 21, drive gear 17, drive chain 18, rod gears 16, drive rods 24, scrub brush mounts 25, and scrub brushes 26. When the motor 20 is powered, the motor shaft 21 moves the drive gear 17, which moves the drive chain 18, which in turn causes the rod gears 16, drive rods 24, scrub brush mounts 25 and scrub brushes 26 to rotate, thereby propelling the hands-free pot scrubber 10 across and cleaning the surface of the cooking utensil. Each scrub brush 26 rotates in a substantially circular motion relative to the common axes of rotation of the associated drive rod 24, scrub brush mount 25 and scrub brush 26.

One skilled in the art will recognize that a hands-free pot scrubber 10 may include alternate mechanisms for driving the motion of the scrub brushes 26, e.g., pulleys and a belt rather than gears and a chain, or direct drive of the scrub brushes 26 or the drive rods 24 by one or more motors.

One skilled in the art will also recognize that a hands-free pot scrubber 10 may be comprised of more than or less than the three sets of rod gears 16, drive rods 24, scrub brush mounts 25 and scrub brushes 26 depicted in FIGS. 1-8. Furthermore, each of the scrub brushes 26 may each be of a different size as depicted in FIGS. 1-8, or one or more may be substantially of a same size. Additionally, each of the sets of rod gears 16, drive rods 24, scrub brush mounts 25 and scrub brushes 26 may be disposed symmetrically around the axis of motor shaft 21. The lengths of the drive rods 24 may differ or be substantially equal.

In one embodiment of a hands-free pot scrubber 10, the circular motion of the scrub brushes 26 is substantially continuous and of uniform speed when the device is operating. In an alternate embodiment, the scrub brush motion alternates in an oscillatory manner between clockwise and counterclockwise motion. In still a further embodiment, the scrub brush motion is intermittent rather than continuous. In yet a further embodiment, the scrub brush motion is two or more of the following: continuous, oscillatory, or intermittent.

As depicted in the front view of FIG. 1, a lead drive rod 24L and a center drive rod 24C have respective axes 46L and 46C that are each oriented at respective angles 56L and 56C of substantially two degrees each relative to the central axis 19 when viewed from the front. As depicted in the side view of FIG. 2, the axis 46T of trailing drive rod 24T is oriented at an angle 66T of substantially two degrees relative to the central axis 19, and axis 46L of lead drive rod 24L is further oriented at an angle 66L of substantially two degrees relative to the central axis 19, when the hands-free pot scrubber 10 is viewed from the side. In this embodiment of the hands-free pot scrubber 10, any angle between a drive rod 24 and the central axis 19 that is not specified above is substantially zero. One skilled in the art will recognize that rod angles other than two degrees relative to the central axis 19 may be used, and that other combinations of angles other than specified above may be used.

This arrangement of drive rods 24 at non-zero angles relative to the central axis 19 causes the scrub brushes 26 to be disposed at non-zero angles, i.e., tilted, relative to the surface of a cooking utensil. Thus, at any given time, one edge of a scrub brush 26 is either lower relative to the surface of the cooking utensil than its opposite edge, or makes better contact, due to greater compression of the scrub brush 26 at that edge, with the surface of the cooking utensil than its opposite edge. For example, in operation, the edge 68 of lead scrub brush 26L is lower relative to the surface of a cooking utensil than the edge 69 of lead scrub brush 26L. The difference in relative height of the two edges of a scrub brush results in better contact and thus greater traction between the lower edge and the surface of the cooking utensil than between the opposite edge and the surface of the cooking utensil. The difference in traction causes the hands-free pot scrubber 10 to be propelled, due to the force of the rotating scrub brushes 26, across the surface of the cooking utensil in the direction of the higher edge. When lead scrub brush 26L and/or trailing scrub brush 26T make contact with the sidewall of a cooking utensil, the resistance of the sidewall to the motion of the hands-free pot scrubber 10 combined with the rotary motions of the scrubbers 26 cause the hands-free pot scrubber 10 to move circularly around the surface of the cooking utensil.

Figure 9:
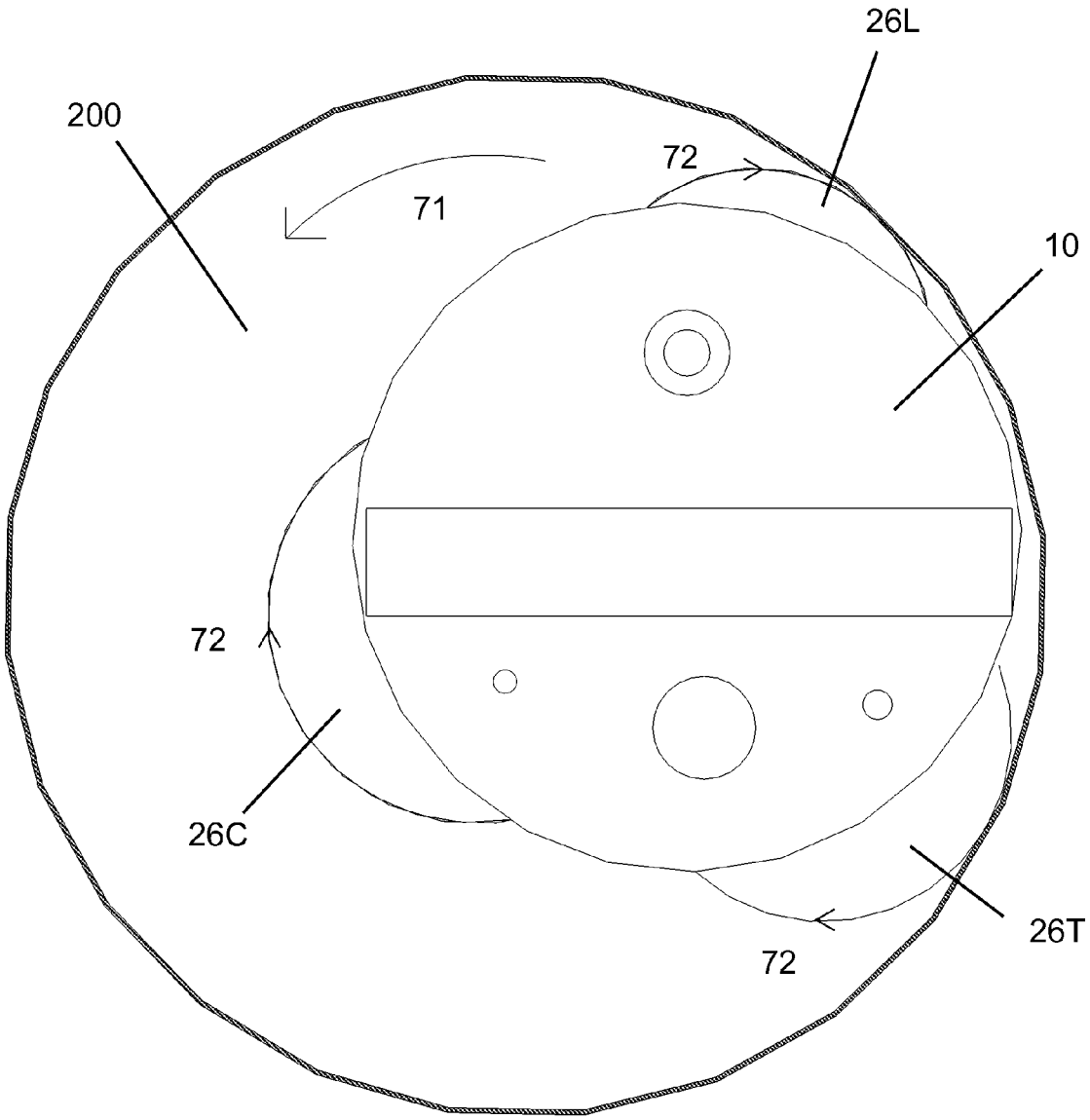
FIG. 9 depicts the motion vectors of an embodiment of a hands-free pot scrubber.

As depicted in FIG. 9, this embodiment of a hands-free pot scrubber 10 will propel itself, due to the rotary motions 72 of the scrub brushes 26, in a substantially circular path 71 across the surface of the cooking utensil 200 that is being cleaned, due in part to the asymmetrical and non-parallel dispositions of the drive rods 24. The rotary motions 72 are clockwise and the circular path 71 is counterclockwise when, as depicted in FIG. 9, viewed from above. One skilled in the art will recognize, however, that counterclockwise rotary motions 72 will work as well, and will induce a hands-free pot scrubber 10 to move in a clockwise circular path 71.

The movement of this embodiment of the hands-free pot scrubber 10 is self-correcting, i.e., it will always align itself so that its direction of motion relative to the surface of the cooking utensil is with the lead scrubber 26L in the front and the trailing scrubber 26T trailing. Typically, when a hands-free pot scrubber 10 is operated to clean a circular cooking utensil 200, the center scrubber 26C cleans a center portion, and the lead scrubber 26L and trailing scrubber 26T clean an outer portion, of the surface of the cooking utensil 200. The petals 28 (FIGS. 3 and 5) of the trailing scrubber 26T also clean the side wall of the cooking utensil 200, and may be made to be flexible to accommodate the varying side wall angles that will be encountered with different cooking utensils. Thus, substantially any initial orientation of a hands-free pot scrubber 10 relative to the cooking utensil will result in the pot scrubber moving over (and thus cleaning) every portion of the interior surface of the cooking utensil.

The invention thus addresses the problems of operating a device for cleaning cooking utensils without hand-guiding the device in its operation and permits an operator to attend to other activities during its operation.

One skilled in the art will recognize that other dispositions or arrangements of the drive rods 24 and thus scrub brushes 26 may also be used to cause a hands-free pot scrubber 10 to self-propel across the surface of the cooking utensil and that the pattern of motion of the hands-free pot scrubber 10 may be other than substantially circular. The components of a hands-free pot scrubber 10 may be made of any suitable material or combination of materials, such as metal, plastic or nylon. The scrub brushes 26 may be made of any suitable scrubbing or scouring material or combination of materials, e.g., steel wool, or nylon brush or pad.

An alternate embodiment of the hands-free pot scrubber 10 includes a shut-off timer (not shown) coupled to the switch 23 that operates to shut off the motor 20 after a pre-determined or selectable time duration (e.g., 1, 2, 3, 4, or 5 minutes) in order to prevent the hands-free pot scrubber 10 from operating for too long a time period. This shut-off feature would be useful, for example, in the event that the operator fails to manually shut off the operation of the hands-free port scrubber 10.

The required weight of a hands-free pot scrubber 10 varies depending upon the type of surface to be cleaned. For example, a weight of approximately 2½ pounds is generally sufficient for cleaning a non-stick surface such as Teflon, while a weight of approximately at least 5½ pounds is typically required for cleaning surfaces that stick like stainless steel and cast iron. A hands-free pot scrubber 10 may include a component (not shown) for increasing its total weight, e.g., one or more water (or other liquid) reservoirs, or detachable metal weights. Adjustment of the total weight permits a user to configure a hands-free pot scrubber 10 according to the particular characteristics of the utensils that require cleaning. In one embodiment of the hands-free pot scrubber 10, the weight distribution of its components is substantially symmetrical about the central axis 19. In an alternate embodiment, the weight distribution increases with radial distance from the central axis 19.

A hands-free pot scrubber 10 may be portable, so that it may easily be carried to a convenient location for use, e.g., sink, stove or countertop. One skilled in the art will recognize that a hands-free pot scrubber 10 may alternatively be constrained in a substantially fixed configuration, e.g., mounted next to a sink with a limited degree of movement sufficient to facilitate use at that location.

Figure 10:
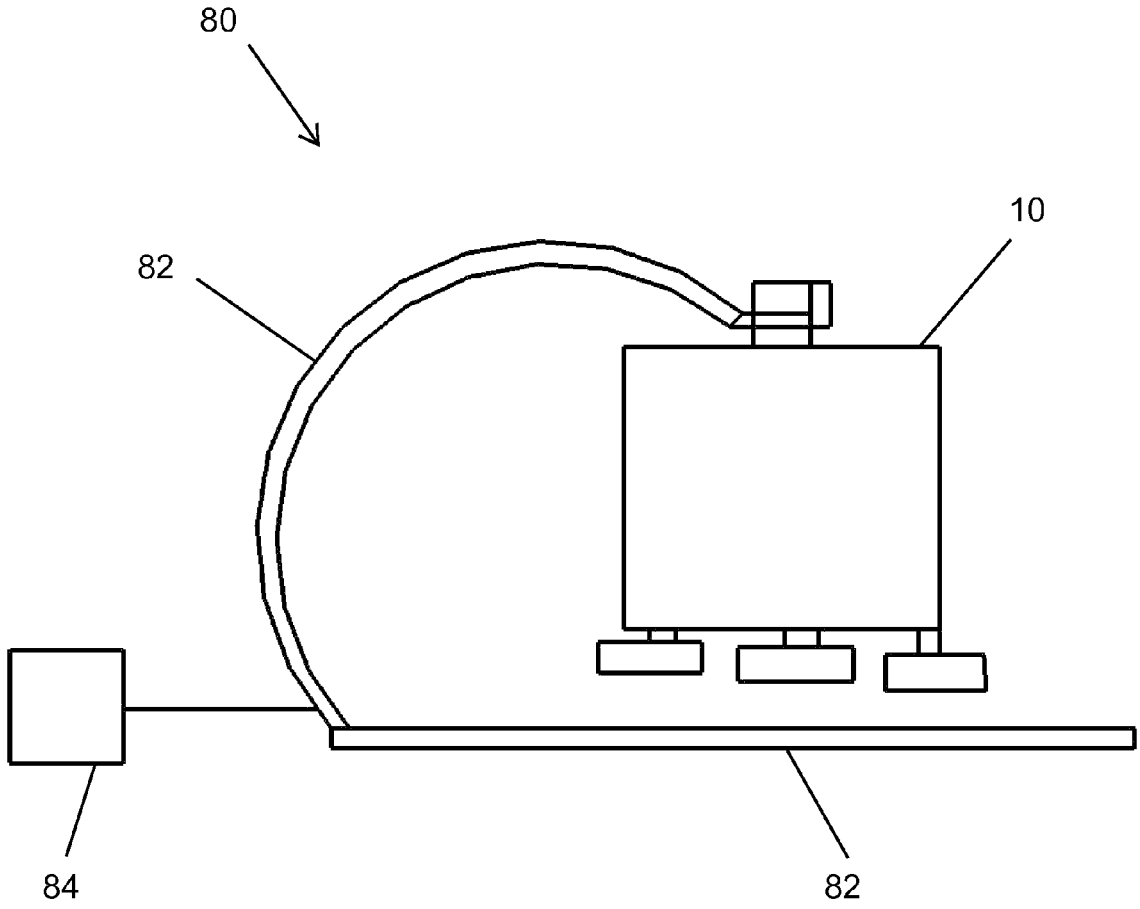
FIGS. 10 and 11 depict a side view and front view, respectively, of an embodiment of a hands-free pot scrubber connected to a charging station.
Figure 11:
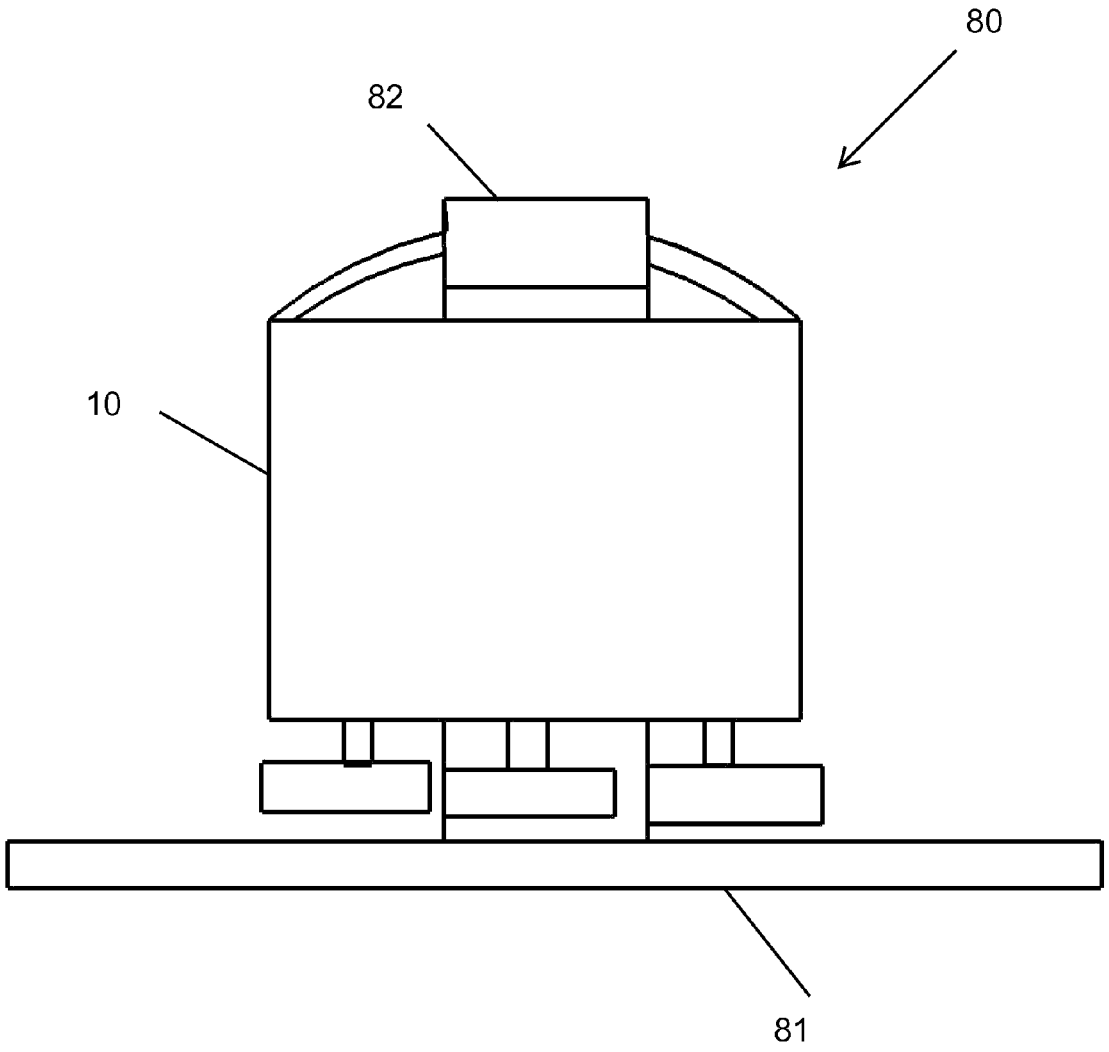
Figure 12:
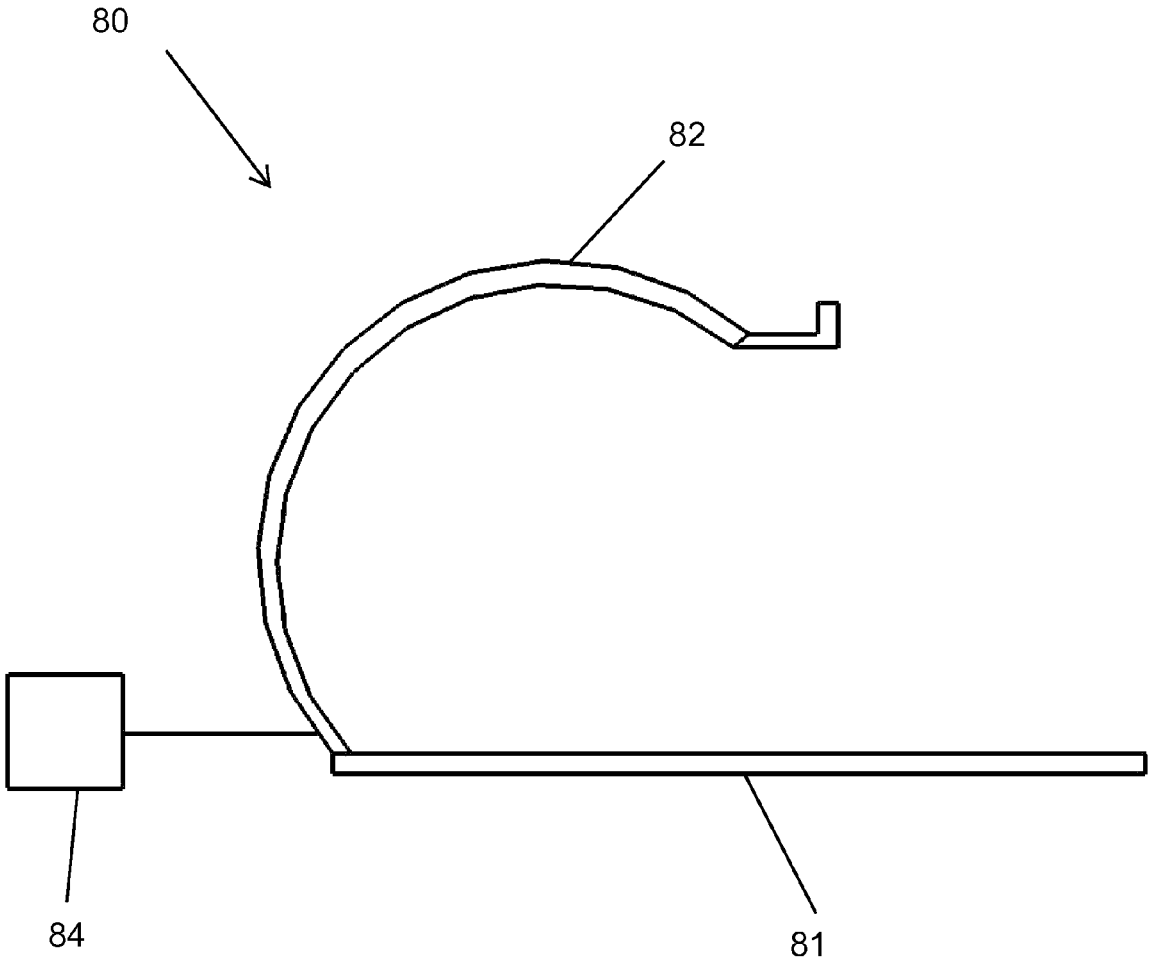
FIGS. 12 and 13 depict a side view and top view, respectively, of the charging station of FIG. 9.
Figure 13:
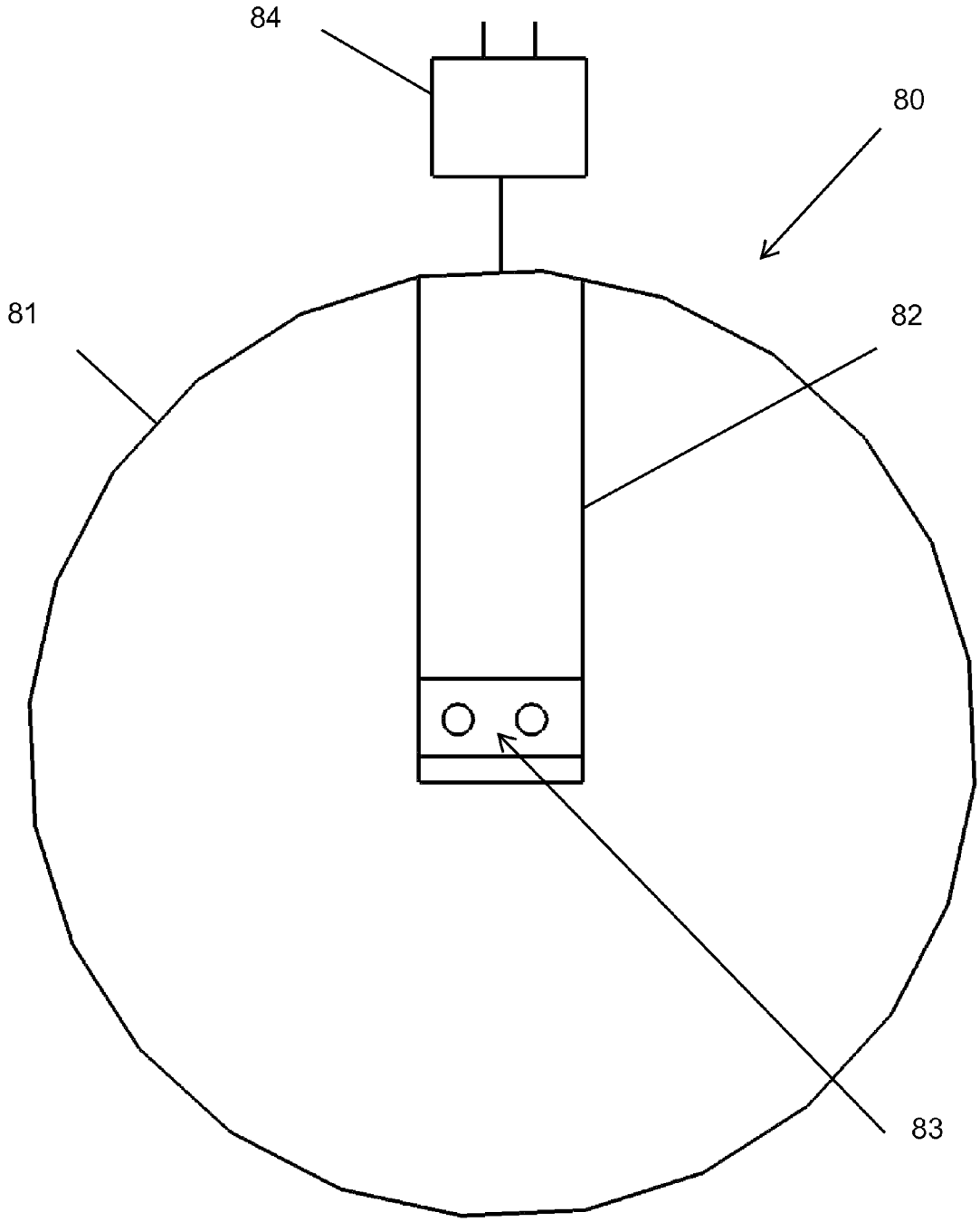

A hands-free pot scrubber 10 may be used in conjunction with a charging stand 80, as depicted in FIGS. 10-11. A charging stand, depicted alone in FIGS. 12-13, may be comprised of a base 81, a supporting arm 82 comprising two or more electrical charging contacts 83, and an electrical plug 84 electrically coupled to the electrical charging contacts 83 for supplying electrical power to the charging contacts 83 when plugged into an electrical outlet (not shown). The handle 12 of the hands-free pot scrubber 10 may have two or more electrical contacts (not shown), which, when the pot scrubber 10 is mounted on the supporting arm 82 of the charging stand 80, mate and make contact with charging contacts 83 for recharging the batteries 22 of the pot scrubber 10.

Figure 14:
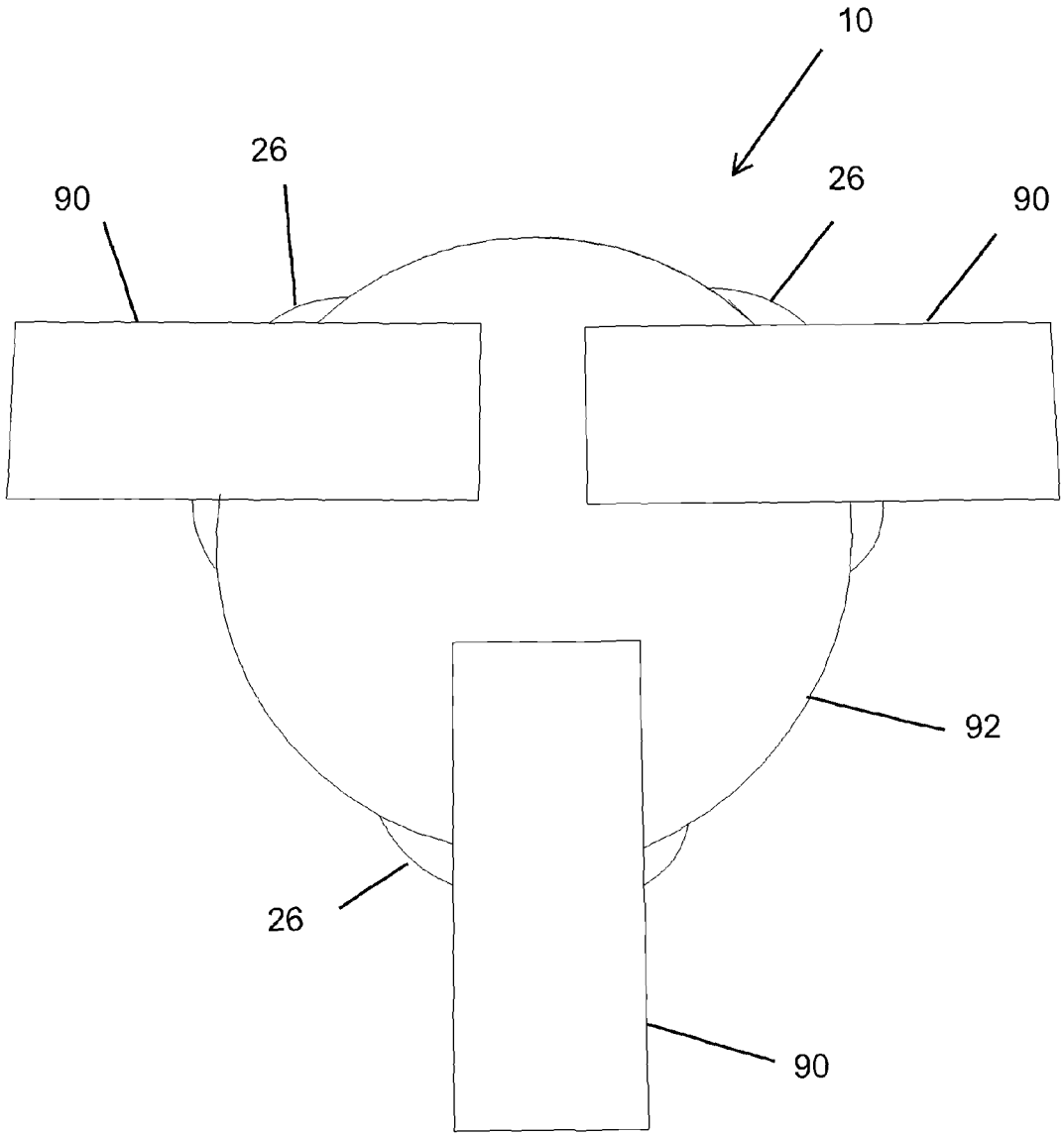
FIGS. 14-16 depict a top, side, and bottom view, respectively, of a second embodiment of a hands-free pot scrubber in accordance with principles of the present invention.
Figure 15:
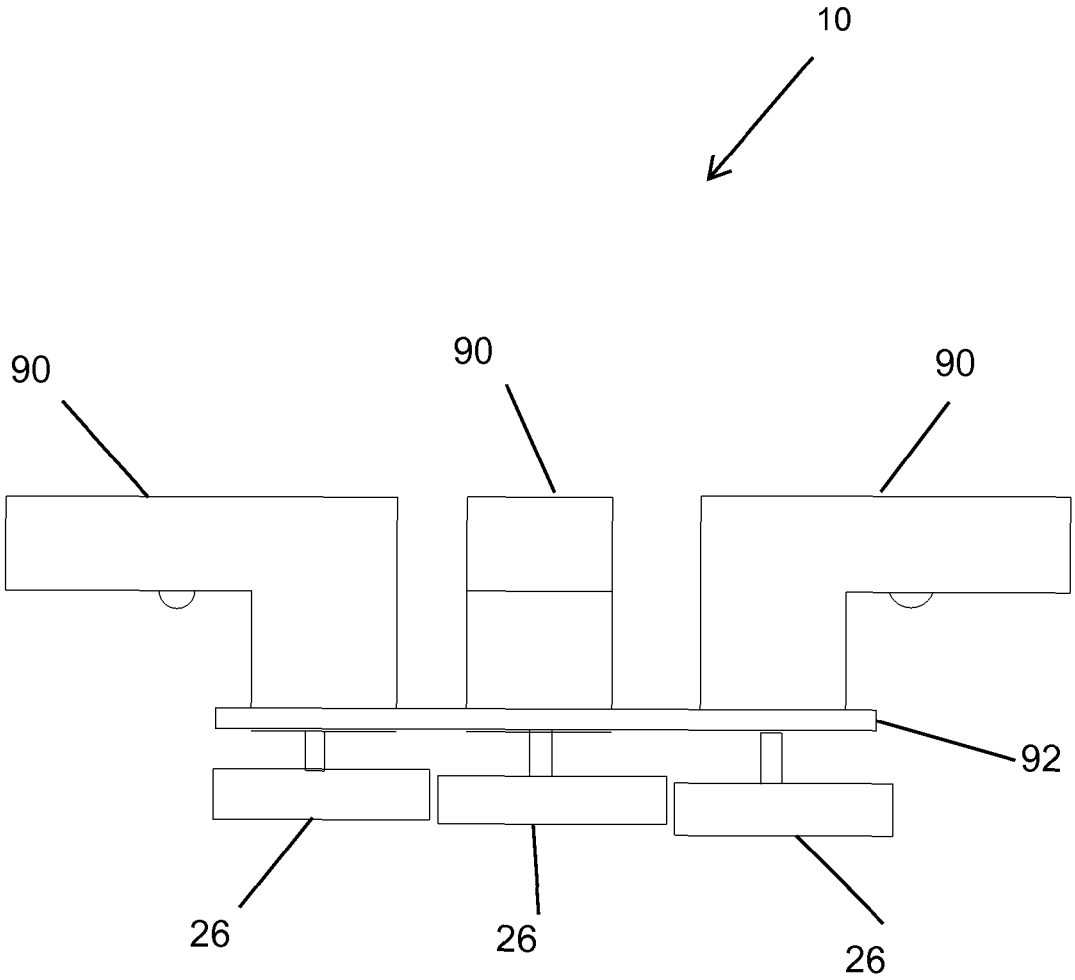
Figure 16:
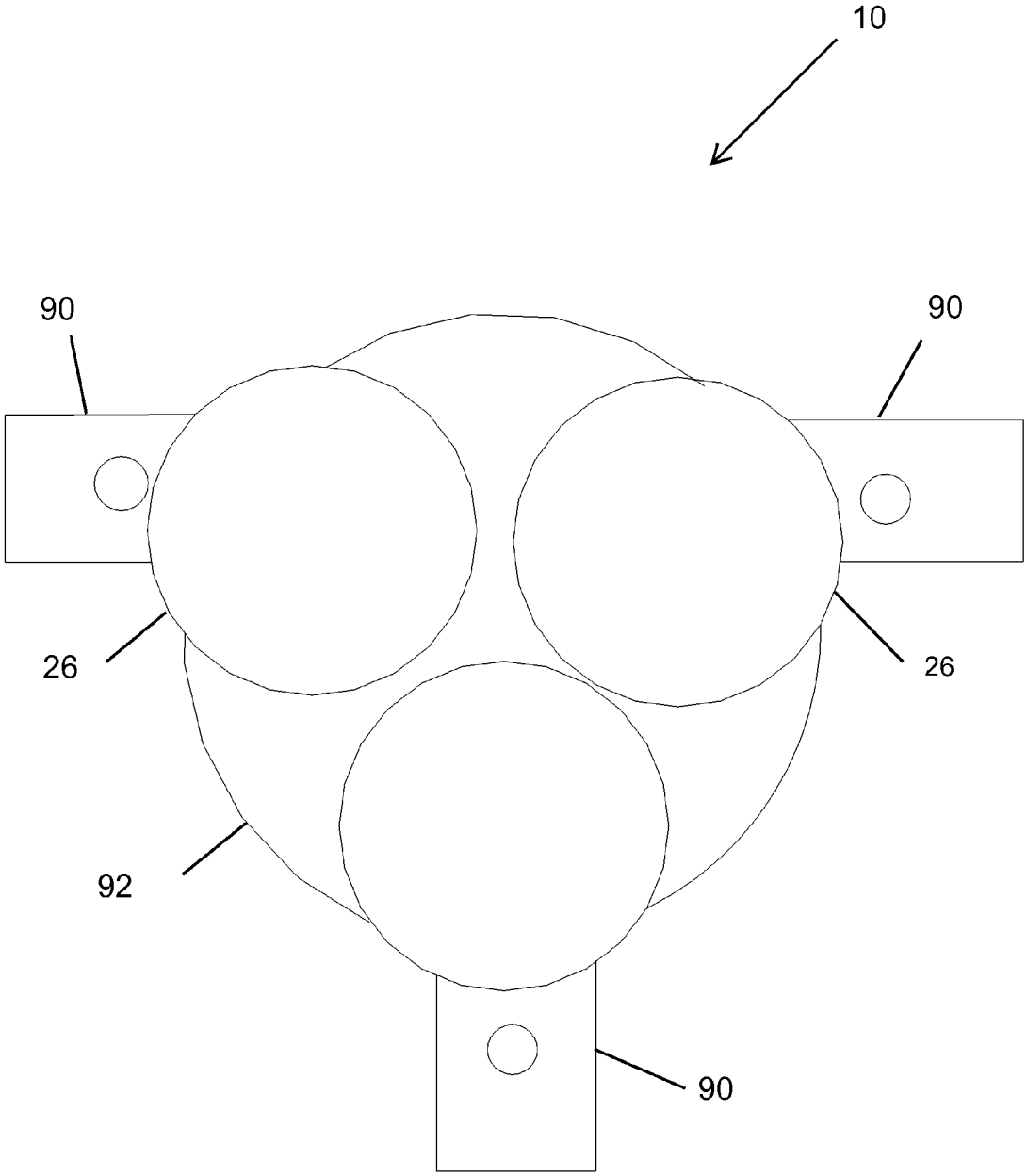

An alternate embodiment of a hands-free pot scrubber 10, depicted in FIGS. 14-16, comprises three detachable hand-held scrubbers 90 and an attachment piece 92 to which each hand-held scrubber 90 may be attached and detached. Each hand-held scrubber 90 has a housing that contains a motor and one or batteries electrically coupled to the motor for supplying electrical power to the motor, and a scrub brush 26 mechanically coupled to the motor.

Each hand-held scrubber 90, when not attached to the attachment piece 92, may be used as a portable hand-held scrubber to clean a cooking utensil. When the three hand-held scrubbers 90 are attached to the attachment piece 92 to form a hands-free pot scrubber 10, the formed hands-free pot scrubber 10 can be used in a manner similar to that described previously for the hands-free pot scrubber 10, and will self-propel itself over, and clean, the surface of a cooking utensil in a similar manner.

While a particular form and use of the present invention has been described above, the invention is not limited to the specific arrangement of parts or manner of use described.

One skilled in the art understands that modifications to the construction and use of the present system may be made without departing from the scope of the invention.

Although the invention has been described in terms of exemplary embodiments, it is not limited thereto. Rather, the appended claims should be construed broadly to include other variants and embodiments of the invention that may be made by those skilled in the art without departing from the scope and range of equivalents of the invention. This disclosure is intended to cover any adaptations or variations of the embodiments discussed herein.

What is claimed is:

1. A hands-free portable device for cleaning a cooking utensil, the device comprising:

one or more motors;

one or more batteries, said batteries electrically coupled to said motors to supply power to the motors; and two or more scrub brushes rotationally coupled to said motors, each scrub brush having an axis of rotation, wherein at least two of said scrub brushes have a non-zero angle between their respective axes of rotation, wherein motion from said motors is rotationally transferred to said scrub brushes, said transferred motion and non-zero angle between the axes of rotation of said at least two scrub brushes causing said device to be self-propelled on the surface of said cooking utensil.

2. The device of claim 1, further comprising:

two or more drive members providing said rotational coupling of said scrub brushes to said motors, said scrub brushes attached to said drive members.

3. The device of claim 2, further comprising:

one or more first gears mechanically coupled to said motors;

one or more second gears mechanically coupled to said drive members; and one or more chains providing mechanical coupling amongst said first gears and said second gears to mechanically transfer motion from said motors to said drive members.

4. The device of claim 2, further comprising:

one or more first pulleys mechanically coupled to said motors;

one or more second pulleys mechanically coupled to said drive members; and one or more belts providing mechanical coupling amongst said first pulleys and said second pulleys to mechanically transfer motion from said motors to said drive members.

5. The device of claim 2, wherein at least one of said drive members comprises a shaft disposed substantially along the axis of rotation of its corresponding scrub brush.

6. The device of claim 2, wherein each of said two or more drive members comprises a shaft, wherein at least one of said shafts has a length that differs from the length of another of said shafts.

7. The device of claim 2, wherein each of said two or more drive members comprises a shaft, wherein each of said shafts has a substantially equal length.

8. The device of claim 1, wherein each of at least two of said two or more scrub brushes have a respective diameter, and further wherein said at least two scrub brushes have different respective diameters.

9. The device of claim 8, wherein said at least two scrub brushes having diameters are of substantially circular shape.

10. The device of claim 1, wherein the motion rotationally transferred to said at least one of said scrub brushes is substantially circular relative to said axis of rotation.

11. The device of claim 10, wherein said substantially circular motion alternates in an oscillatory manner between clockwise and counterclockwise motion.

12. The device of claim 1, further comprising a housing having a central axis and containing said motors, said batteries and said scrub brushes, wherein said scrub brushes are disposed asymmetrically relative to said central axis of said housing.

13. The device of claim 12, wherein said two or more scrub brushes are arranged asymmetrically around said central axis.

14. The device of claim 12, wherein said two or more scrub brushes are arranged symmetrically around said central axis.

15. The device of claim 1, further comprising:

a sensor for detecting the proximity or contact of the device with an external object, wherein the motion of said scrub brushes is altered upon said detecting.

16. The device of claim 1, wherein said non-zero angle is substantially two degrees.

17. The device of claim 1, wherein each of said scrub brushes has a cleaning surface substantially perpendicular to the axis of rotation of said scrub brush.

18. The device of claim 1, wherein the weight of the device is approximately 2½ pounds.

19. The device of claim 1, wherein the weight of the device is at least 5½ pounds.

20. The device of claim 1, further comprising a component for increasing its total weight.

21. The device of claim 20, wherein the component for increasing its total weight comprises a liquid reservoir or a detachable metal weight.

22. A hands-free device for cleaning a cooking utensil, the device comprising:

one or more motors;

one or more rechargeable batteries, said batteries electrically coupled to said motors to supply power to the motors;

two or more scrub brushes rotationally coupled to said motors, wherein motion from said motors is rotationally transferred to said scrub brushes, thereby causing said device to be self-propelled on the surface of said cooking utensil;

a housing for containing said one or more motors and said one or more rechargeable batteries;

a handle attached to said housing, said handle comprising two or more first electrical contacts electrically coupled to said one or more rechargeable batteries for recharging said batteries; and a charging stand comprised of:

a base:

a supporting arm comprising two or more second electrical contacts for mating with said first electrical contacts to recharge said batteries when said handle is mounted on top of said supporting arm; and an electrical plug for receiving electrical power from an electrical outlet, said electrical plug electrically coupled to said second electrical contacts.

23. A device for cleaning a cooking utensil, the device comprising:

two or more hand-held scrubbers, wherein each hand-held scrubber comprises:

a housing containing:

a motor; and a battery, said battery electrically coupled to the motor to supply power to the motor;

a scrub brush rotationally coupled to the motor, said scrub brush having an axis of rotation;

one or more attachment members for attaching the housings of said hand-held scrubbers together, wherein at least two of said scrub brushes of said hand-held scrubbers have a non-zero angle between their respective axes of rotation when said hand-held scrubbers are attached together, wherein motion from said motors is rotationally transferred to said scrub brushes, said transferred motion and non-zero angle between the axes of rotation of said at least two scrub brushes causing said device to be self-propelled on the surface of said cooking utensil.

24. The device of claim 23, wherein said attachment member comprises a holder having a central axis, wherein said housings of said scrubbers attach to, and detach from, said holder and are arranged in a configuration substantially symmetrical relative to the central axis of said holder.

25. The device of claim 23, wherein said non-zero angle is substantially two degrees.

26. A hands-free portable device for cleaning a cooking utensil, the device comprising:

one or more motors;

one or more batteries, said batteries electrically coupled to said motors to supply power to the motors; and two or more scrub brushes rotationally coupled to said motors, each scrub brush having an axis of rotation, wherein at least one of said scrub brushes has a non-zero angle between its axis of rotation and an axis that is perpendicular to the surface of the cooking utensil, wherein motion from said motors is rotationally transferred to said scrub brushes, said transferred motion and non-zero angle between the axis of rotation of said at least one scrub brush and the axis that is perpendicular to the surface of the cooking utensil causing said device to be self-propelled on the surface of said cooking utensil.

27. The device of claim 26, wherein the hands-free portable device has a central axis disposed substantially in the center of the device and that is substantially parallel to the axis that is perpendicular to the surface of the cooking utensil.

* * * * *